US005751322A

United States Patent [19]

Miller et al.

[11] Patent Number: 5,751,322

[45] Date of Patent: May 12, 1998

[54] LIMITED ACCESS NEEDLE/SEPTUM INK-SUPPLY INTERFACE MECHANISM

[75] Inventors: Gary L. Miller; Kenneth R. Williams, both of Vancouver, Wash.

[73] Assignee: Hewlett-Packard Company, Palo Alto, Calif.

[21] Appl. No.: 601,166

[22] Filed: Feb. 13, 1996

[51] Int. Cl.[6] ..... B41J 2/175

[52] U.S. Cl. ..... 347/86

[58] Field of Search ..... 347/85, 86, 87

[56] References Cited

U.S. PATENT DOCUMENTS

| | | | |
|---|---|---|---|
| 3,929,071 | 12/1975 | Cialone et al. | 101/335 |
| 4,074,284 | 2/1978 | Dexter et al. . | |
| 4,156,244 | 5/1979 | Erikson et al. . | |
| 4,162,501 | 7/1979 | Mitchell et al. | 346/140 R |
| 4,183,031 | 1/1980 | Kyser et al. | 346/140 R |
| 4,303,929 | 12/1981 | Blanck | 346/140 R |
| 4,345,627 | 8/1982 | Cassia . | |
| 4,419,678 | 12/1983 | Kasugayama et al. | 346/140 R |
| 4,447,820 | 5/1984 | Terasawa . | |
| 4,496,959 | 1/1985 | Frerichs . | |
| 4,593,294 | 6/1986 | Parisi . | |
| 4,700,202 | 10/1987 | Kuranishi et al. . | |
| 4,760,409 | 7/1988 | Kiyohara et al. . | |
| 4,814,794 | 3/1989 | Sato . | |
| 4,831,389 | 5/1989 | Chan | 346/140 R |
| 4,849,773 | 7/1989 | Owatari | 346/140 R |
| 4,888,602 | 12/1989 | Watanabe et al. . | |
| 4,898,209 | 2/1990 | Zbed . | |
| 4,928,126 | 5/1990 | Asai . | |
| 4,999,652 | 3/1991 | Chan | 346/140 R |
| 5,114,032 | 5/1992 | Laidlaw | 215/356 |
| 5,119,115 | 6/1992 | Buat et al. . | |
| 5,126,767 | 6/1992 | Asai . | |
| 5,232,109 | 8/1993 | Tirrell et al. | 215/247 |
| 5,289,211 | 2/1994 | Morandotti et al. | 346/140 R |
| 5,311,214 | 5/1994 | Hirasawa et al. . | |
| 5,359,356 | 10/1994 | Ecklund . | |
| 5,400,066 | 3/1995 | Matsumoto et al. . | |
| 5,574,489 | 11/1996 | Cowger et al. | 347/86 |

FOREIGN PATENT DOCUMENTS

| | | |
|---|---|---|
| 516 088 A2 | 12/1992 | European Pat. Off. . |
| 567 308 A2 | 10/1993 | European Pat. Off. . |
| 665 108 A2 | 8/1995 | European Pat. Off. . |
| 26 32 580 | 1/1978 | Germany . |
| 60-179258 | 2/1994 | Japan . |
| 2001911 | 2/1979 | United Kingdom . |
| WO 90/00972 | 2/1990 | WIPO . |

*Primary Examiner*—Adolf Berhane

[57] ABSTRACT

In an ink-delivery system of an ink-jet printer, the needle of the interface mechanism is fully recessed into a cavity of a needle-holding structure and the septum seals the end of a hollow tower. The connection between the needle and a septum tower allows for transportation of ink from an ink reservoir to an ink-jet pen in the printhead. The tower is configured to be inserted into the cavity so that the needle pierces the septum. To prevent needle pricks and cuts, the cavity has an aperture with a diameter less than that of a human finger. Therefore, the narrow diameter aperture prevents inadvertent digital access to the needle. Furthermore, the septum tower may be attached to a replaceable component, such as an ink reservoir or a pen. Each time that a component is replaced, the relative positioning of its septum tower may change. A floating-bushing assembly loosely retains the needle-holding structure so that the structure has limited freedom to move. The limited movement may be translational and/or rotational. Thus, when the tower and needle are brought together, the assembly allows the needle-holding structure to shift and to rotate. This compensates for the relative repositioning of the tower while making an effective connection between the needle and the septum.

13 Claims, 4 Drawing Sheets

LIMITED ACCESS NEEDLE/SEPTUM INK-SUPPLY INTERFACE MECHANISM

TECHNICAL FIELD

The present invention relates to an ink-delivery system of an ink-jet printer. More particularly, it relates to an ink-supply interface mechanism wherein an ink needle piercing a septum provides an interface mechanism for transporting ink from an ink-supply to an ink-jet printhead. More particularly still, the needle of such a system is recessed into a cavity having a diameter less than that of a human finger, thereby limiting access to the recessed needle.

BACKGROUND ART

An ink-jet printing mechanism prints images and text on a page by firing drops of ink from the one or more pens in a printhead while the printhead moves back and forth across the page. An ink-jet printer is a device utilizing such an ink-jet printing mechanism. Examples of ink-jet printers include plotters, facsimile machines, and typical computer-attached ink-jet printers. The page on which a printer prints may be any sheet material, such as paper, mylar, foils, transparencies, card stock, etc.

The ink supply of an ink-jet printer is limited. Since it is potentially very messy for users to refill their ink reservoirs, many printers are designed to have replaceable/disposable/recyclable ink reservoirs. A user simply replaces the old, empty ink reservoir with a new, full ink reservoir. The life of an ink-jet pen is also limited. The pens suffer mechanical breakdowns and/or simply wear-out after firing millions of drops of ink. Therefore, the pens of a typical ink-jet printer are designed to be replaced, as necessary, by new pens.

In so-called cartridge-type printers, the pens are formed as cartridges with an ink reservoir therein. The printhead of the cartridge-type printers carries its ink supply with it as the printhead travels back and forth across the page. However, in so-called off-axis printers, only the printhead moves across the page. The ink is delivered to the printhead via a flexible tube from a stationary ink reservoir. Typically, the ink reservoir is mounted to the printer chassis and may be replaced or refilled when empty. Off-axis printers may be equipped either with a single printhead for monochromatic printing, or with several printheads for color printing. Of course, for color printing, several reservoirs and associated tubes are required, with one set used for each color.

In the ink-delivery systems of off-axis printers, ink is transported from one ink-delivery locus to the other via the ink-delivery tube. The printhead and the ink reservoir are the printer components that typically embody the ink-delivery loci of an ink-delivery system of an off-axis printer. The component of an ink-delivery loci must interface with the ink-delivery tube. At this interface, the tube may be permanently attached; however, this would prevent replacement of the attached component. Alternatively, the tube may terminate in a hypodermic-like needle for piercing a resilient septum which seals a replaceable printer component. A needle/septum interface mechanism allows for occasional replacement of removable components.

In a typical needle/septum interface mechanism, a hypodermic-like needle is operatively connected to an ink-delivery locus so as to provide for fluid communication therethrough. The septum is operatively connected to the other ink-delivery locus. For example, the ink-delivery locus to which the needle is connected may be the printhead and the locus to which the septum is connected may be the ink reservoir. In this example, when the needle pierces the septum, the ink flows from the ink reservoir to the septum through an ink-delivery tube and, from there, it flows through the needle to the printhead. Of course, the example can be reversed so that the ink-delivery locus to which the needle is connected is the ink reservoir and the locus to which the septum is connected is the printhead. In this second example, when the needle pierces the septum, the ink flows from the ink reservoir to the needle through an ink-delivery tube and, from there, it flows through the septum to the printhead.

The needle of a needle/septum interface mechanism is typically quite sharp so that it may easily pierce the septum, thereby reducing the stress on the pen and avoid damaging the septum. When the sharp needle is not engaged with a septum, the needle is exposed and capable of pricking or cutting the finger of a person.

DISCLOSURE OF THE INVENTION

The present invention overcomes the drawbacks of existing needle/septum ink-supply interface mechanisms. In particular, according to one aspect of the present invention, the needle of the interface mechanism is fully recessed into a cavity of a needle-holding structure and the septum seals the end of a hollow tower. The tower is configured to be inserted into the cavity so that the needle pierces the septum. To prevent needle pricks and cuts, the cavity has an aperture with a diameter less than that of a human finger. Therefore, the narrow diameter aperture prevents access to the needle. As a result, the interface mechanism of the present invention is safer than other existing interface mechanisms. Furthermore, the septum tower may be attached to a replaceable component, such as an ink reservoir or a pen. Each time that a component is replaced, the relative positioning of its septum tower may change. According to another aspect of the present invention, a floating-bushing assembly loosely retains the needle-holding structure so that the structure has limited freedom to move. The limited movement may be translational and/or rotational. Thus, when the tower and needle are brought together, the assembly allows the needle-holding structure to shift and to rotate. This compensates for the relative repositioning of the tower while making an effective connection between the needle and the septum.

One object and advantage of the present invention is to limit or eliminate human contact with the exposed needle.

Another object and advantage of the present invention is to automatically align and reconnect a permanent component with a replaceable component that may be slightly misaligned relative to the permanent component.

These and other objects and advantages of the present invention will be more readily understood after a consideration of the drawings and the detailed description of the preferred embodiment which follows.

DETAILED DESCRIPTION OF THE PREFERRED EMBODIMENTS AND BEST MODE FOR CARRYING OUT THE INVENTION

Figure 1:
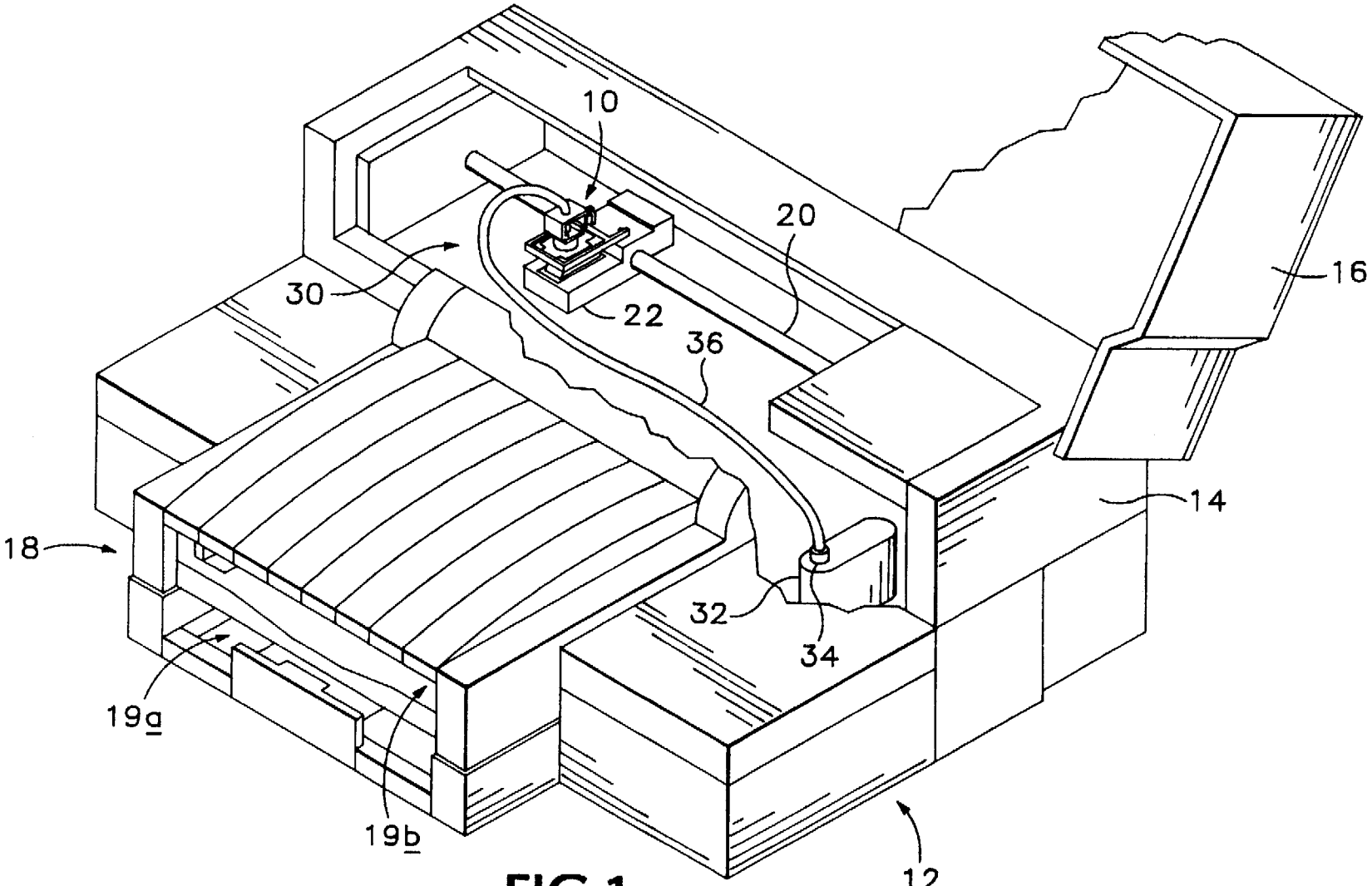
FIG. 1 is an isometric view of an off-axis ink-jet printer with a printhead/carriage assembly and a needle station, constructed in accordance with a preferred embodiment of the invention.

The limited access needle/septum ink-supply interface mechanism, constructed in accordance with a preferred embodiment, is shown generally at 10 in FIGS. 1–6. FIG. 1 illustrates an off-axis ink-jet printer utilizing an embodiment of the needle/septum interface mechanism. Although FIG. 1 shows a particular embodiment of an ink-jet printer, any type of an ink-jet printer may utilize the invention. For example, plotters, portable printing units, and facsimile machines are types of ink-jet printers which may utilize the present invention.

As shown in FIG. 1, off-axis ink-jet printer 12 includes a chassis 14 having a lift-up lid 16. The printer further includes a page handling system 18 for storing blank pages and temporarily storing printed pages. For the purpose of explaining the present invention, lift-up lid 16 is unnecessary; thus, only a fragmentary portion of it is shown and that portion is raised to reveal the internal mechanisms of the printer. Also, portions of chassis 14 are cut away to further reveal the internal mechanisms of the printer. In particular, the revealed internal mechanisms include an ink-delivery system 30 for delivering ink to a printhead on a printhead/carriage assembly 22, which rides a guide rod 20 as the assembly moves side-to-side to print images and text on a page.

Page handling system 18 feeds blank pages into the printer one-at-a-time and advances each page past the printhead so that images and/or text may be printed thereon. The page handling system typically has a feed tray 19*a* for storing blank pages, an output tray 19*b* for temporarily storing printed pages, and a drive mechanism (not shown) for page advancement. In a typical ink-jet printer, printhead/carriage assembly 22 is driven from side-to-side across a page along guide rod 20 by, for example, a conventional drive belt/pulley and motor assembly (not shown). The printhead of assembly 22 has an orifice plate (not shown) on its bottom surface. The orifice plate has a plurality of nozzles through which drops of ink are expelled. The printhead selectively deposits one or more ink droplets on the page in accordance with commands received from a print controller (not shown), such as a microprocessor located within chassis 14.

Ink-delivery system 30, shown in FIG. 1, effectively transports ink between ink-delivery loci of the printer. The ink-delivery loci include the ink supply in an ink reservoir 32 and the printhead—which is part of printhead/carriage assembly 22. In the preferred embodiment of this invention, any conventional mechanism may be implemented to propel the ink from reservoir 32 to the printhead of assembly 22. The ink used in the ink-delivery system may be any suitable fluid colorant or any other suitable liquid intended to cover part of a page. The ink is stored in ink reservoir 32 and is delivered via a tubing 36 to printhead/carriage assembly 22. The tubing is preferably flexible so that it may bend as the printhead/carriage assembly moves back and forth across the page. Tubing 36 may be constructed in a conventional manner from a variety of different elastomers and plastics, known to those skilled in the art. The tubing and ink reservoir may be connected via any conventional interface mechanism. If ink reservoir 32 is replaceable, then connection 34 between the tubing and the reservoir is preferably a reusable-type connection so that a new ink reservoir can replace a depleted one.

The printing mechanism of an ink-jet printer typically includes printhead/carriage assembly 22 and ink-delivery system 30. As illustrated in FIG. 1, the printing mechanism may be monochromatic for printing a single color, such as black. Alternatively, the printing mechanism may be multi-chromatic, for printing combinations of colors, such as cyan, yellow and magenta. Only the monochromatic embodiment of the printing mechanism is shown and described herein to illustrate the present invention. However, a printer using an embodiment of the present invention may be either monochromatic or multi-chromatic. Those who are skilled in the art will understand and appreciate that a multi-chromatic embodiment will include a plurality of similar features and functions as the depicted monochromatic embodiment.

Figure 2:
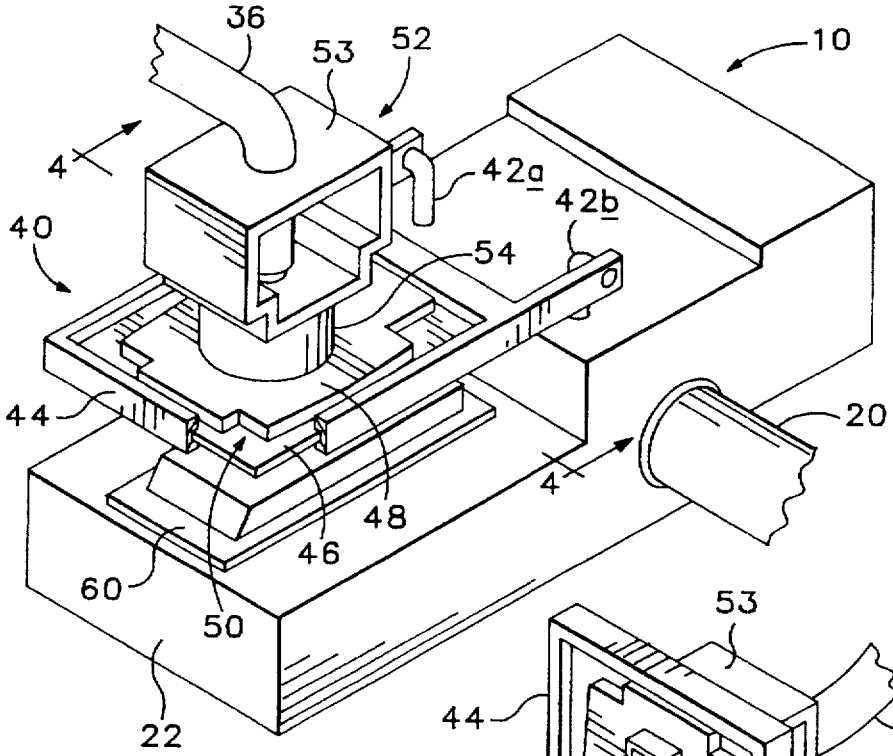
FIG. 2 is an enlarged, fragmentary isometric view of the printhead/carriage assembly and the needle station of FIG. 1.
Figure 3:
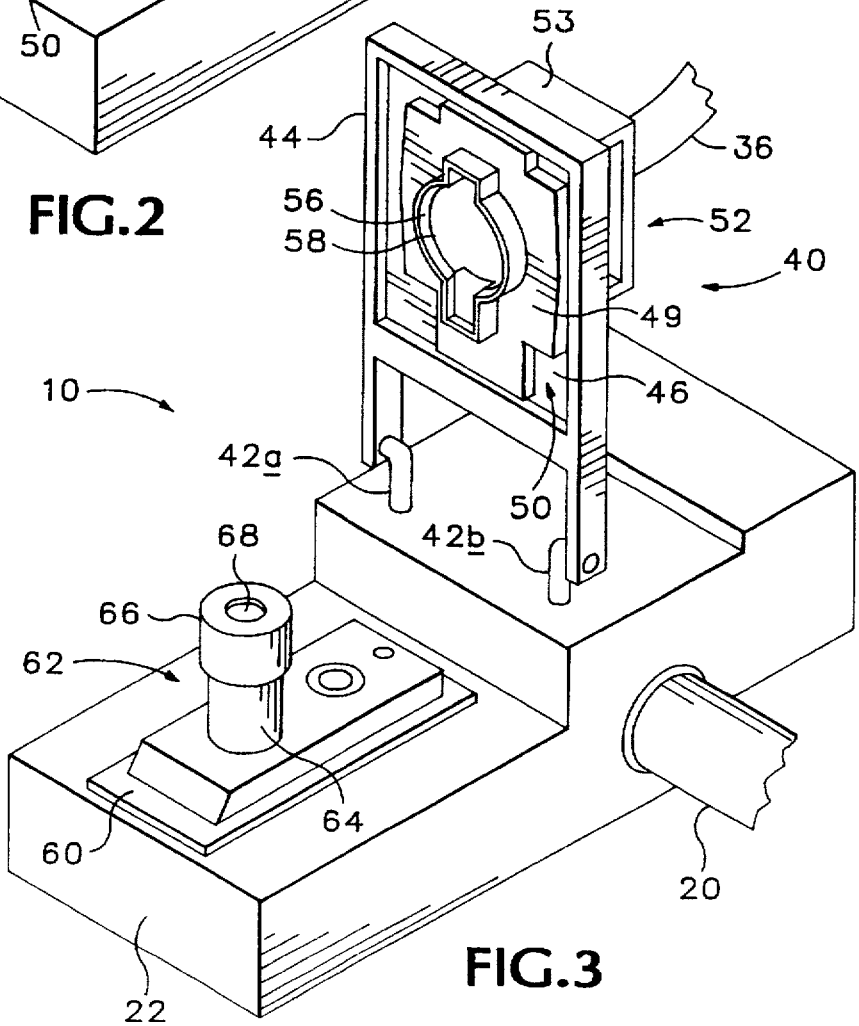
FIG. 3 is an isometric view similar to FIG. 2, except that the needle station is shown pivoted away from the printhead/carriage assembly.

Now that the printer environment and ink-delivery system have been described, the reader's attention is now directed to FIGS. 2–6 and the following description of the preferred embodiment of limited access needle/septum ink-supply interface mechanism 10. FIGS. 2 and 3 show an enlarged view of printhead/carriage assembly 22 on guide rod 20 with a needle station 40 shown in either its engaged position (see FIG. 2) or its disengaged position (see FIG. 3). The needle station is preferably pivotally mounted to printhead/carriage assembly 22 by pivot mounts 42*a*, 42*b*. The needle station includes a frame 44 that holds a planar valve plate 46 therein. FIG. 2 shows a corner of frame 44 cut away to better illustrate valve plate 46. The valve plate includes a central opening (shown in FIGS. 4A–6) through which a cylinder 54 extends.

Figure 4A:
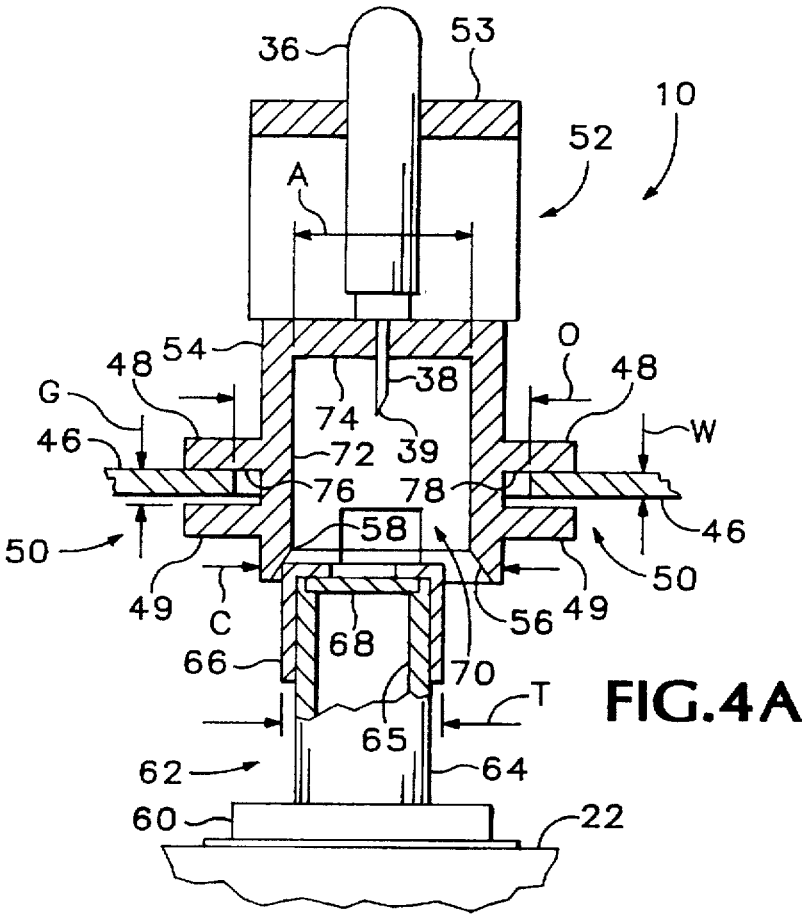
FIGS. 4A and 4B are simplified cross-sectional views of the needle station taken along a transverse plane indicated by line 4—4 of FIG. 2, wherein the depicted needle station is shown with a fragmentary cross-section of a septum tower structure.

As shown in FIGS. 2 and 3, needle station 40 also includes a needle-holding structure 52 having a block 53 connected to cylinder 54. Structure 52 holds and supports ink-delivery tubing 36. As shown in FIG. 4A, needle station 40 includes a fully recessed ink needle 38 that is operatively connected to tubing 36 and mounted inside a central cavity 70 of cylinder 54 and held, in part, by block 53. As shown in FIGS. 3 and 4A, the cavity has an aperture defined by a peripheral lip 58. The needle station also includes a collar 56 which is connected to the cylinder and encircles the aperture.

As shown in FIGS. 2–6, needle station 40 also includes a floating-bushing assembly 50. It loosely retains structure 52 in a manner that allows limited movement of the structure. That limited movement may be translational and/or rotational. The floating-bushing assembly includes valve plate 46 with its opening through which the needle-holding structure is positioned. It also includes upper and lower flanges 48, 49 connected to and extending from cylinder 54. The flanges are positioned on opposite sides of the plate so that the flanges and the plate effectively hold the cylinder. FIG. 2 shows upper flange 48 and FIG. 3 shows lower flange 49.

FIG. 3 shows the needle station disengaged and pivoted away from printhead/carriage assembly 22. The top of pen housing 60 of the replaceable pen is shown. The remainder of the housing is hidden from view because it is within the printhead/carriage assembly so that the pen itself is at the printhead. The replaceable pen includes a septum tower 62 that projects upwardly from the housing. It provides a location for interfacing the pen with the ink-delivery system.

Tower 62 includes a hollow tower member 64 having an exposed end that is topped by a septum 68 which is, in turn, partially crowned by a cap 66. Inside the hollow tower member, an ink conduit 65 (shown in FIGS. 4A–5) completes the connection to the final ink-delivery locus, the printhead. The ink conduit is sealed by the septum. Septum 68 is preferably constructed of a single resilient material, such as an elastomeric material, for instance, a silicone elastomer or an EDPM elastomer. The septum is easily pierced by the sharp needle and preferably reseals when the needle is retracted.

To provide fluid communication between the pen of replaceable pen housing 60 and ink reservoir 32, septum 68 is pierced by ink needle 38, which is fully recessed into cavity 70. Thus, tower 62 must be inserted into the cavity. As illustrated by FIGS. 2 and 3, this is accomplished in the preferred embodiment by pivotally mounting needle station 40 to printhead/carriage assembly 22 so that it may pivot toward and away from tower 62.

FIGS. 4A–6 show a simplified cross-sectional view of needle station 40 with either tower 62 or a human finger 80. The cross section is taken along a transverse plane indicated by line 4—4 of FIG. 2. Background structures that are unnecessary for explaining the structure and operation of needle/septum interface mechanism 10 are not shown in the cross-sectional views of FIGS. 4A–6. FIGS. 4A and 4B show a sequence of events illustrating tower 62 being inserted into cavity 70. FIG. 4A shows them approaching each other, but the tower is contacting collar 56. FIG. 4B shows the tower fully inserted into the cavity with the needle piercing the septum. FIGS. 2 and 3 show and the above description explains that needle station 40 moves in three dimensions when it swings towards tower 62 about an axis formed by pivot mounts 42*a*, 42*b*. However, for the purpose of illustration, FIGS. 4A and 4B have been simplified so that they do not show the third dimension of motion (which is towards or away from the viewer of FIGS. 4A and 4B) or the rotational motion of the station.

As shown in FIGS. 4A, cavity 70 is defined by cavity walls 72 and a cavity ceiling 74. Since tower 62 of the preferred embodiment is cylindrical, the cavity has a mateably cylindrical or circular shape so that the cavity may receive the tower. In the preferred embodiment, a diameter A of the aperture of the cavity—which is defined by peripheral lip 58—is approximately 7.8 millimeters (mm) and a diameter T of the tower is approximately 7.6 mm. Thus, the tower may fit into the cavity.

Needle 38 is centrally mounted in cavity ceiling 74 so that the needle extends into the cavity a short distance such that a sharp, pointed end 39 of the needle does not extend beyond peripheral lip 58. An orifice is adjacent the pointed end of the needle. It provides an outlet for ink flowing through the hypodermic-like needle from ink-delivery tubing 36. In the preferred embodiment, needle 38 has a cross-sectional diameter of approximately 1.0 mm. In order to promote resealing of the septum when the needle is withdrawn, it is desirous for the septum to have a large diameter relative to the diameter of the needle. In the preferred embodiment, the diameter of the septum is roughly seven times the diameter of the needle, thereby facilitating resealing of the septum after the needle is retracted.

Whenever the station is disengaged, degrees of positional tolerances may be introduced. In particular, when the pen is replaced, the wide diameter tower of the pen may be in a slightly different position relative the station than before the station was disengaged. Based on the dimensions of the preferred embodiment and in light of the desirably large diameter septum, a relative repositioning of the tower by as much as approximately 1.0 mm could prevent connection of the needle and septum to complete ink communication with the new pen. Also, as shown in FIGS. 2 and 3, the needle station pivots towards the tower. Upon entry into the cavity, the tower inserts into the cavity with an arching-like motion that corresponds to the rotation of the station. In addition, other factors apparent to those skilled in the art exists that introduce additional degrees of positional tolerances.

To overcome this situation, the preferred embodiment of the present invention incorporates a tolerance device that facilitates connection despite relative positional changes. Specifically, the preferred embodiment includes a floating-bushing assembly 50 which allows a limited degree of movement for needle-holding structure 52. This limited movement may include translation and/or rotation. With the preferred embodiment, needle-holding structure 52 may move back-and-forth and/or side-to-side (i.e., in two dimensions) about one to three millimeters from the concentric center of the aperture and the opening. As shown in FIG. 4A, the cylinder has a diameter C and the opening of valve plate 46 has a diameter O. Diameter O is greater than the cylinder's diameter C by a distance which defines the extent of limited translational movement permitted by said floating-bushing assembly. In the preferred embodiment, that distance is approximately 3.0 mm because diameter O is about 13.0 mm and diameter C is about 10.0 mm.

The floating-bushing assembly effectively facilitates alignment of the needle-holding and tower so that the needle pierces the septum with a minimum of effort and mechanical resistance. To assist in the alignment, collar 56 has an acutely angled surface relative to the tower. As shown in FIG. 4A, the angled surface acts as an inclined plane when the cap touches the surface, thereby urging the cylinder over slightly so that the tower may fit within the cavity.

Figure 4B:
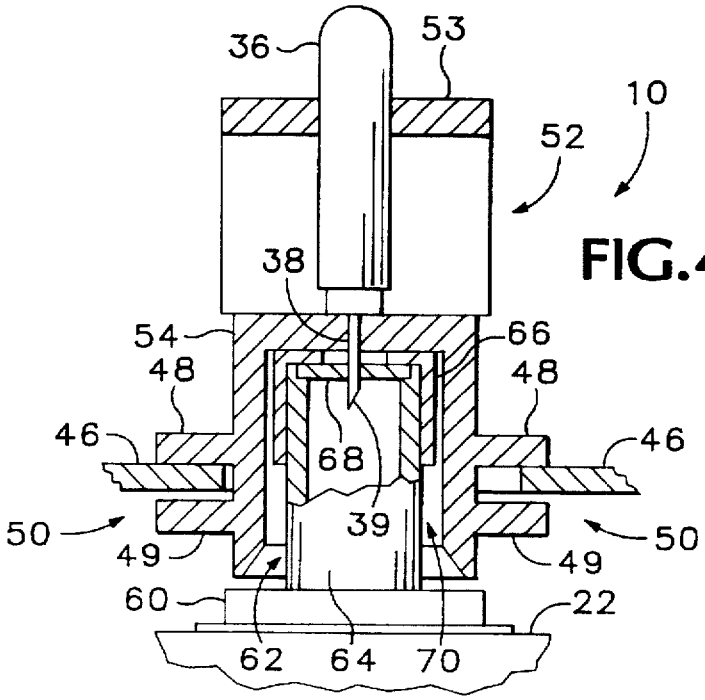

FIG. 4B shows a successful connection between needle 38 and septum 68 where tower 62 is fully inserted into cavity 70. In the preferred embodiment, ink flows from the ink reservoir to the needle through ink-delivery tubing 36 and, from there, it flows through the septum tower to the pen of the printhead. The tower of FIGS. 4A and 4B is perpendicular relative to printhead/carriage assembly 22. As such, needle-holding structure 52 does not need to rotate in order to make a successful connection with the tower. However, pen housing 60 may be placed in assembly 22 in a manner that does not affect pen operation and effectiveness but leaves the housing and its tower 62 slightly tilted. A limited rotational movement of the needle-holding structure would allow a successful connection despite the tilting of the tower.

In general, rotational movement of structure 52 facilitates a successful connection between the needle and the septum. A successful connection is one in which the needle extends straight into the tower so that the needle is substantially parallel to the interior walls of ink conduit 65. The rotational movement of the structure counterbalances the effect of the rotation of station 40 toward tower 62 so that a successful connection may be achieved.

Figure 5:
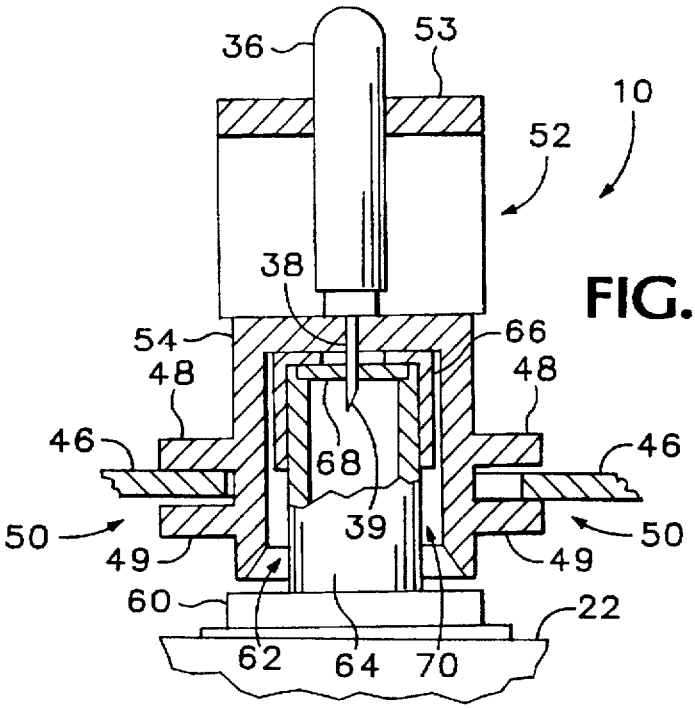
FIG. 5 is a simplified cross-sectional view of the needle station similar to FIG. 4B.

FIG. 5 demonstrates the limited rotational movement permitted by floating-bushing assembly 50 to compensate for a slightly tilted tower. In FIG. 5, only printhead/carriage assembly 22 and valve plate 46 are level. Housing 60 and its tower are slightly tilted. As the viewer views FIG. 5, the tower leans toward the left. Floating-bushing assembly 50 allows needle-holding structure 52 to compensate and rotate accordingly.

Tolerance gaps 76, 78 (shown in FIG. 4A) are formed on either side of cylinder 54 between flanges 48, 49 and between the outer wall of the cylinder and the rim of the opening of plate 46. As shown in FIG. 4A, the plate has a width W and the gaps have a width G. The degree of limited rotational movement permitted by said floating-bushing assembly is defined by the difference between the plate's width and the gaps' width. The rotation allowed by this arrangement is about an axis which is parallel with the plane of the plate. In the preferred embodiment, the degree of rotation permitted is approximately 5°–10°.

Figure 6:
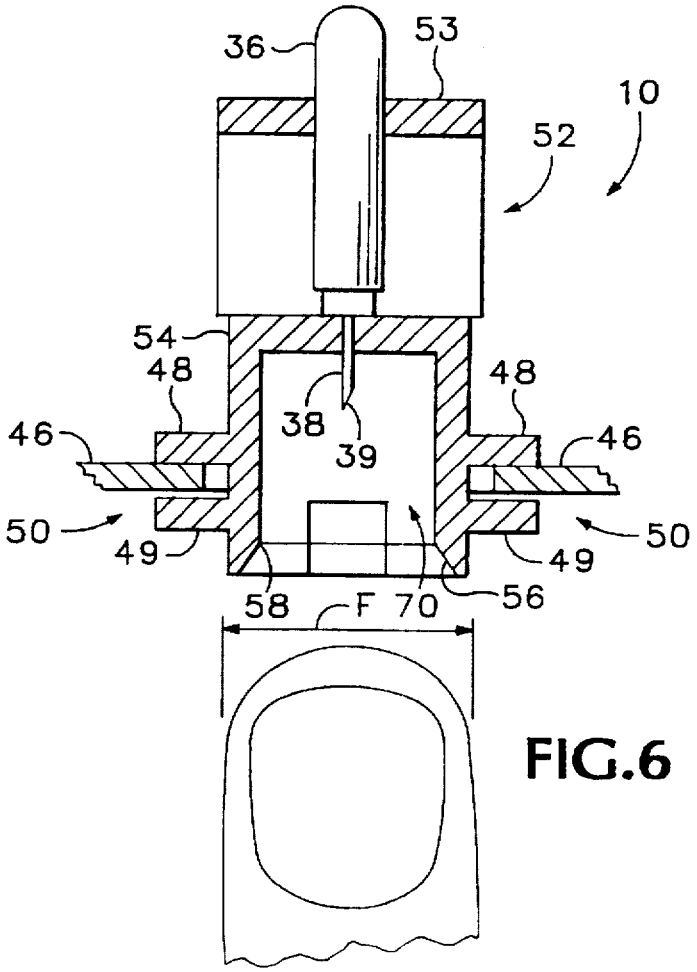
FIG. 6 is a simplified cross-sectional view of the needle station similar to FIG. 4A, except that the needle station is shown with a human finger rather than the septum tower.

FIG. 6 illustrates a human finger near the aperture of cavity 70. The depicted finger has a diameter F that is no smaller than 8.0 mm. The aperture of the cavity has diameter A where A is less than F. In the preferred embodiment, diameter is A is approximately 7.8 mm which is less than 8.0 mm. High-voltage electricity safety standards establish a human finger model that has a minimum effective diameter of approximately 8.0 mm. Examples of such a standard human finger model is defined by the regulatory design requirements of IEC 950, UL 1950 and CSA 950. Although these safety design requirements were not designed to prevent human contact with a needle, a mechanism that meets these requirements would logically prevent access to a recessed needle as well as a recessed electrical connection. The preferred embodiment of the present invention meets the regulatory design requirements of the above agencies in so far as it prevents or limits digital access to a recessed needle.

INDUSTRIAL APPLICABILITY

Although particularly well-suited for use for an ink-jet printer, the above-described limited access needle/septum interface mechanism may be used in any fluid transportation system, wherein the needle may be subject to human contact.

While the present invention has been shown and described with reference to the foregoing operational principles and preferred embodiment, it will be apparent that to those skilled in the art that various changes in form and detail may be made without departing from the spirit and scope of the invention as defined by the appended claims.

We claim:

1. An ink-supply interface mechanism for use in an ink-jet printer to transport ink between ink-delivery loci in an ink-delivery system of the printer, the interface mechanism comprising:

a needle station including a needle-holding structure and a floating-bushing assembly, said needle-holding structure having a cavity therein, and said structure further having an ink needle mounted and fully recessed within said cavity, said needle being operatively connected to an ink-delivery locus, said floating-bushing assembly retaining said structure in a manner allowing limited movement of said structure, and a septum tower attached to the printer adjacent said needle station, said tower including an exposed end, with an ink conduit extending through said tower operatively connecting another ink-delivery locus thereto, and a septum covering said exposed end and sealing said conduit, wherein said tower and said cavity are configured so that when they are brought together, said tower fits within said cavity in such a manner that said needle pierces said septum, thereby operatively connecting the ink-delivery loci so that ink may flow therebetween.

2. The interface mechanism of claim 1, wherein said cavity of said needle-holding structure has an aperture with a narrow diameter that substantially prevents ingression of a human finger into said cavity.

3. The interface mechanism of claim 1, wherein said needle-holding structure also has a peripheral collar extending around the periphery of said aperture, wherein said collar has an acutely angled surface relative to said tower for urging said structure, when said tower contacts the surface while said tower and said needle approach each other, in a manner that aligns said tower with said cavity.

4. The interface mechanism of claim 1, wherein said floating-bushing assembly has a plate with an opening through which said needle-holding structure is positioned and includes upper and lower flanges connected to said structure and positioned on opposite sides of said plate so that said flanges and said plate effectively hold said structure.

5. The interface mechanism of claim 4, wherein said structure has a diameter and said opening of said plate has a diameter that is greater than said structure's diameter by an amount which defines an extent of limited translational movement permitted by said floating-bushing assembly.

6. The interface mechanism of claim 4, wherein said plate is planar and has a width and wherein a gap located between said flanges has a width that is greater than said plate'width by an amount which defines a degree of limited rotational movement permitted by said floating-bushing assembly, wherein the rotational movement is about an axis which is parallel with the plane of said plate.

7. The interface mechanism of claim 2, wherein the diameter of said aperture of said cavity is less than 8 millimeters.

8. An ink-supply interface mechanism for use in an ink-jet printer to transport ink between ink-delivery loci in an ink-delivery system of the printer, the interface mechanism comprising:

a needle station including a needle-holding structure and a floating-bushing assembly, said needle-holding structure having a cavity therein with an aperture having a narrow diameter that substantially prevents ingression of a human finger into said cavity, and said structure further having an ink needle mounted and fully recessed within said cavity, said needle being operatively connected to an ink-delivery locus, said floating-bushing assembly retaining said structure in a manner allowing limited movement of said structure, wherein said floating-bushing assembly has a plate with an opening through which said needle-holding structure is positioned and includes upper and lower flanges connected to said structure and positioned on opposite sides of said plate so that said flanges and said plate effectively hold said structure, and a septum tower attached to the printer adjacent said needle station, said tower including an exposed end, an ink conduit extending through said tower operatively connecting another ink-delivery locus thereto, and a septum covering said exposed end and sealing said conduit, wherein said tower and said cavity are configured so that when they are brought together, said tower fits within said cavity in such a manner that said needle pierces said septum, thereby operatively connecting the ink-delivery loci so that ink may flow therebetween.

9. The interface mechanism of claim 8, wherein said needle-holding structure also has a peripheral collar extending around the periphery of said aperture, wherein said collar has an acutely angled surface relative to said tower for urging said structure, when said tower contacts the surface while said tower and said needle approach each other, in a manner that aligns said tower with said cavity.

10. The interface mechanism of claim 8, wherein said structure has a diameter and said opening of said plate has a diameter that is greater than said structure's diameter by an amount which defines an extent of limited translational movement permitted by said floating-bushing assembly.

11. The interface mechanism of claim 10, wherein said plate is planar and has a width and wherein a gap located between said flanges has a width that is greater than said plate's width by an amount which defines a degree of limited rotational movement permitted by said floating-bushing assembly, wherein the rotation movement is about an axis which is parallel with the plane of said plate.

12. The interface mechanism of claim 8, wherein the diameter of said aperture of said cavity is less than 8 millimeters.

13. An ink-supply interface mechanism for use in an ink-jet printer to transport ink between ink-delivery loci in an ink-delivery system of the printer, the interface mechanism comprising:

a needle-holding structure having a cavity therein, said cavity having an aperture with a narrow diameter that substantially prevents ingression of a human finger into said cavity, a peripheral collar extending around a periphery of said aperture, wherein said collar has an acutely angled surface, said structure including an ink needle operatively connected to an ink-delivery locus, said needle being mounted and fully recessed within said cavity, and a septum tower including an exposed end, with an ink conduit extending through said tower operatively connecting said tower to another ink-delivery locus, and a septum covering said exposed end and sealing said conduit, said tower being configured to fit within said cavity in such a manner that said needle pierces said septum, thereby operatively connecting the ink-delivery loci so that ink may flow therebetween;

said angled surface of said collar being configured to urge said structure, when said tower contacts said angled surface while said tower and said needle approach each other, in a manner that aligns said tower with said cavity.

* * * * *